US007691032B2

(12) United States Patent
Burnham et al.

(10) Patent No.: US 7,691,032 B2
(45) Date of Patent: Apr. 6, 2010

(54) UNDERGROUND TRAMPOLINE RING DESIGN

(76) Inventors: Tracy Burnham, 3231 NW. Millcreek, Pleasant Grove, UT (US) 84062; K. Donald Evans, 3232 W. Clarkston Cir., South Jordan, UT (US) 84095; Mark Muller, 5016 Cedar River Trail, Fort Worth, TX (US) 76137; Jerry Leopold, 3920 Harlington La., Richardson, TX (US) 75082; Cory E. Cook, 3012 King Mtn. Ct., Riverton, UT (US) 84065

( * ) Notice: Subject to any disclaimer, the term of this patent is extended or adjusted under 35 U.S.C. 154(b) by 0 days.

(21) Appl. No.: 11/857,595

(22) Filed: Sep. 19, 2007

(65) Prior Publication Data

US 2008/0081739 A1 Apr. 3, 2008

Related U.S. Application Data

(60) Provisional application No. 60/850,137, filed on Oct. 6, 2006.

(51) Int. Cl.
*A63B 5/11* (2006.01)

(52) U.S. Cl. ..... 482/29; 482/27

(58) Field of Classification Search ..... 482/27–29, 482/35; 52/169.7, 169.9, 741.13; 2/311
See application file for complete search history.

(56) References Cited

U.S. PATENT DOCUMENTS

| | | | | | |
|---|---|---|---|---|---|
| 2,548,200 | A * | 4/1951 | Critchley et al. | ..... | 24/323 |
| 2,861,277 | A * | 11/1958 | Hermann | ..... | 220/642 |
| 3,155,987 | A * | 11/1964 | McGill | ..... | 2/322 |
| 3,648,303 | A * | 3/1972 | Stewart et al. | ..... | 52/5 |
| 3,959,830 | A * | 6/1976 | van den Broek | ..... | 52/287.1 |
| 4,182,087 | A * | 1/1980 | Schall et al. | ..... | 52/169.7 |
| 4,860,914 | A * | 8/1989 | Derni et al. | ..... | 220/4.28 |
| 4,887,397 | A * | 12/1989 | Peterson | ..... | 52/86 |
| 5,123,874 | A * | 6/1992 | White, III | ..... | 454/251 |
| 5,592,702 | A * | 1/1997 | Gillebaard, Jr. | ..... | 4/506 |
| 5,791,106 | A * | 8/1998 | Nimmo et al. | ..... | 52/248 |
| 6,071,213 | A * | 6/2000 | Raasch et al. | ..... | 482/29 |
| 6,647,562 | B1 * | 11/2003 | Arout et al. | ..... | 4/506 |
| 2005/0054485 | A1 * | 3/2005 | McDermott et al. | ..... | 482/27 |

* cited by examiner

*Primary Examiner*—Fenn C Mathew
*Assistant Examiner*—Andrew M Tecco
(74) *Attorney, Agent, or Firm*—Holland & Hart LLP

(57) ABSTRACT

An in-ground trampoline system configured to provide a ground level jumping surface which consists of a trampoline, a pit, and a segmented retaining wall configured to support the walls of the pit.

10 Claims, 9 Drawing Sheets

UNDERGROUND TRAMPOLINE RING DESIGN

RELATED APPLICATIONS

The present application claims priority under 35 U.S.C. § 119(e) of previously-filed U.S. Provisional Patent Application No. 60/850,137, filed Oct. 6, 2006, entitled "Underground Trampoline Ring Design," which is incorporated herein by reference in its entirety.

BACKGROUND

Trampolines provide popular recreational opportunities among children and young adults, as well as athletes engaged in competitive gymnastics. Although popular in use, above-ground trampolines are often characterized as unsafe because of a significant number of trampoline-related injuries. Specifically, the most common trampoline-related injuries include sprains, cuts, concussions, and various forms of bodily fractures, including life-threatening fractures to the skull and spine. Many such injuries occur when the trampoline user falls from the above-ground trampoline and sustains injury upon impact with the surface below the trampoline. The extent of the injuries is often exacerbated by the added height of the above-ground trampoline. When combined with the jump height, the added height of the trampoline increases the energy of impact, which, in turn, increases the severity of the injury.

In an effort to reduce the number and severity of trampoline fall-related injuries, medical associations have recommended that the trampoline jumping surface be positioned at ground level, thereby reducing the fall height. Notwithstanding such recommendations, there have been barriers to implementing trampoline systems having a ground-level jumping surface, including cost, non-standard design and construction requirements, difficulties in construction, and/or difficulties in disassembling and relocating the in-ground trampoline unit.

Although recreational users recognize the need for an in-ground trampoline system (i.e., placing the trampoline jumping mat or surface at ground level), there has heretofore not been a cost effective, convenient mechanism for individual homeowners or recreational users to install an in-ground trampoline system. The primary challenge of installing and maintaining an in-ground trampoline is the construction of a retaining wall around the perimeter of pit within which the trampoline is placed. Many of the retaining wall systems available to the homeowner or professional landscaper are expensive, massive, and require highly complex construction such as railroad tie wall systems, concrete pours, timber lattices, or the like. In addition, these conventional retaining walls are difficult to dissemble or remove when the homeowner relocates or desires to make landscaping alterations. Further, these massive retaining walls can represent an additional hazard to the trampoline user who falls from the trampoline and impacts the retraining wall.

Therefore, it is readily apparent that there is a need for an inexpensive, modular in-ground trampoline system and method of installation there of, wherein a user can enjoy the safety and accessibility of an outdoor ground-level trampoline jumping surface without undue expense and/or overly complex construction, and is provided with the further advantages and features described herein below.

BRIEF DESCRIPTION OF THE DRAWINGS

The accompanying drawings illustrate various embodiments of the principles described herein and are a part of the specification. The illustrated embodiments are merely examples and do not limit the scope of the claims.

FIGS. 9*a* and 9*b* are diagrams of an exemplary in-ground trampoline system, according to the principles described here in.

Throughout the drawings, identical reference numbers designate similar but not necessarily identical elements.

DETAILED DESCRIPTION

In the following description, for purposes of explanation, numerous specific details are set forth in order to provide a thorough understanding of the present systems and methods. It will be apparent, however, to one skilled in the art that the present apparatus, systems and methods may be practiced without these specific details. Reference in the specification to "an embodiment," "an example" or similar language means that a particular feature, structure, or characteristic described in connection with the embodiment or example is included in at least that one embodiment, but not necessarily in other embodiments. The various instances of the phrase "in one embodiment" or similar phrases in various places in the specification are not necessarily all referring to the same embodiment.

Figure 1:
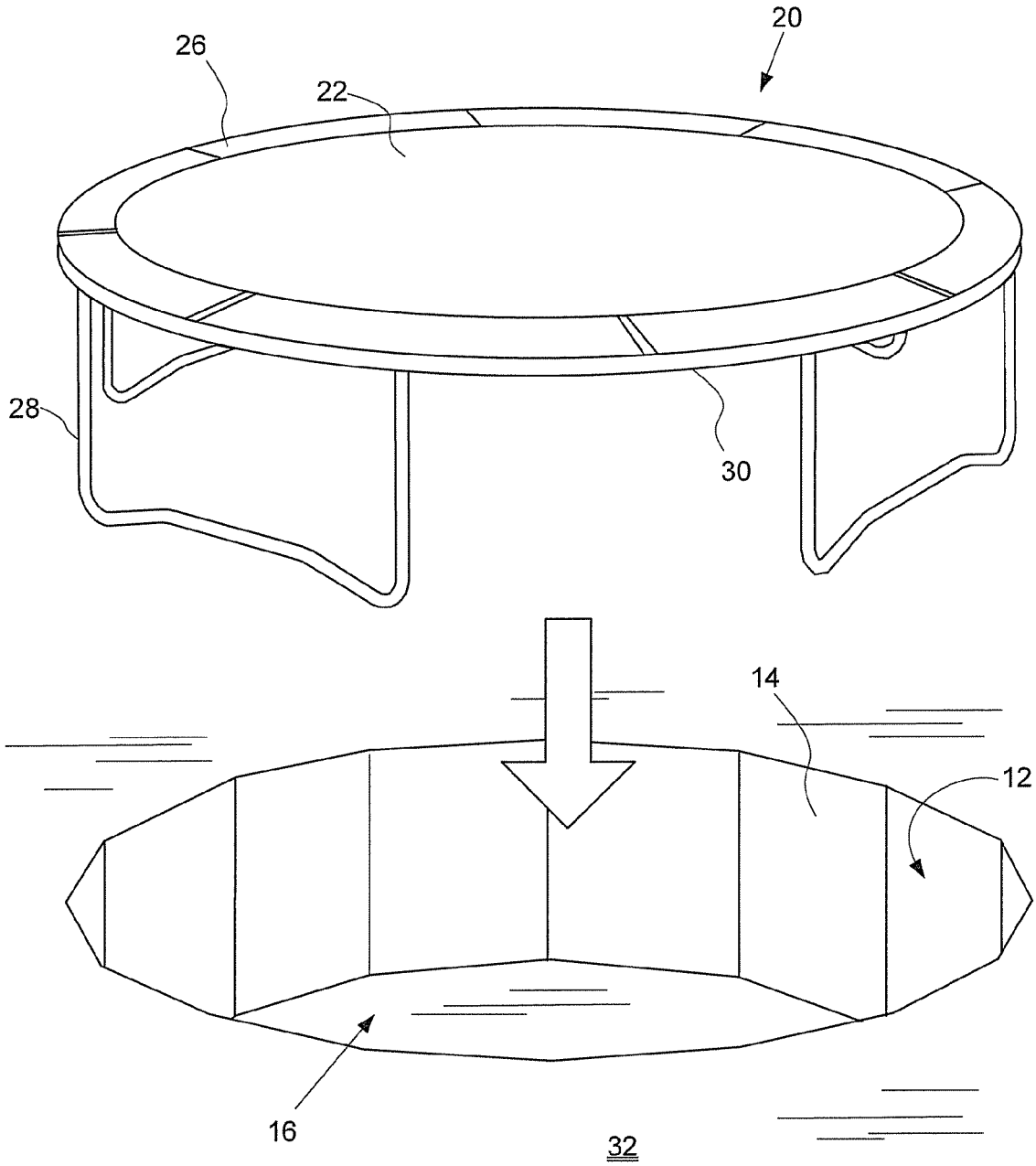
FIG. 1 is an exploded perspective view of an in-ground trampoline system according to the principles described herein.

Now referring to FIG. 1, an exploded perspective view of an exemplary in-ground trampoline system is shown including a segmented retaining wall (12) made up of multiple panels (14) lining the wall of pit (16), configured to receive the trampoline (20). The trampoline (20) comprises a trampoline mat (22), protective pad (26), frame (30), and a plurality of legs (28). The mat (22) can be coupled to the frame (30) by a plurality of resistive elements such as springs or cords (not shown).

In constructing an in-ground trampoline assembly, the user first creates a pit (16). The pit (16) is a depression below the surrounding surface (32) of sufficient depth to receive the trampoline (20). The segmented retaining wall (12) is then placed within the pit (16) to maintain the pit geometry. The retaining wall (12) is created from interlocking panels (14) and forms a barrier capable of stabilizing the wall of the pit (16). The trampoline (20) is then placed within the pit and is supported by the trampoline legs (28) which rest on the bottom of the pit (16). When the trampoline (20) is placed within the pit (16), the trampoline mat (22) is preferably at substantially the same height as the surrounding surface (32), thus reducing the danger of injury to a trampoline user who falls off the trampoline mat (22) and impacts the surface (32).

Figure 2:
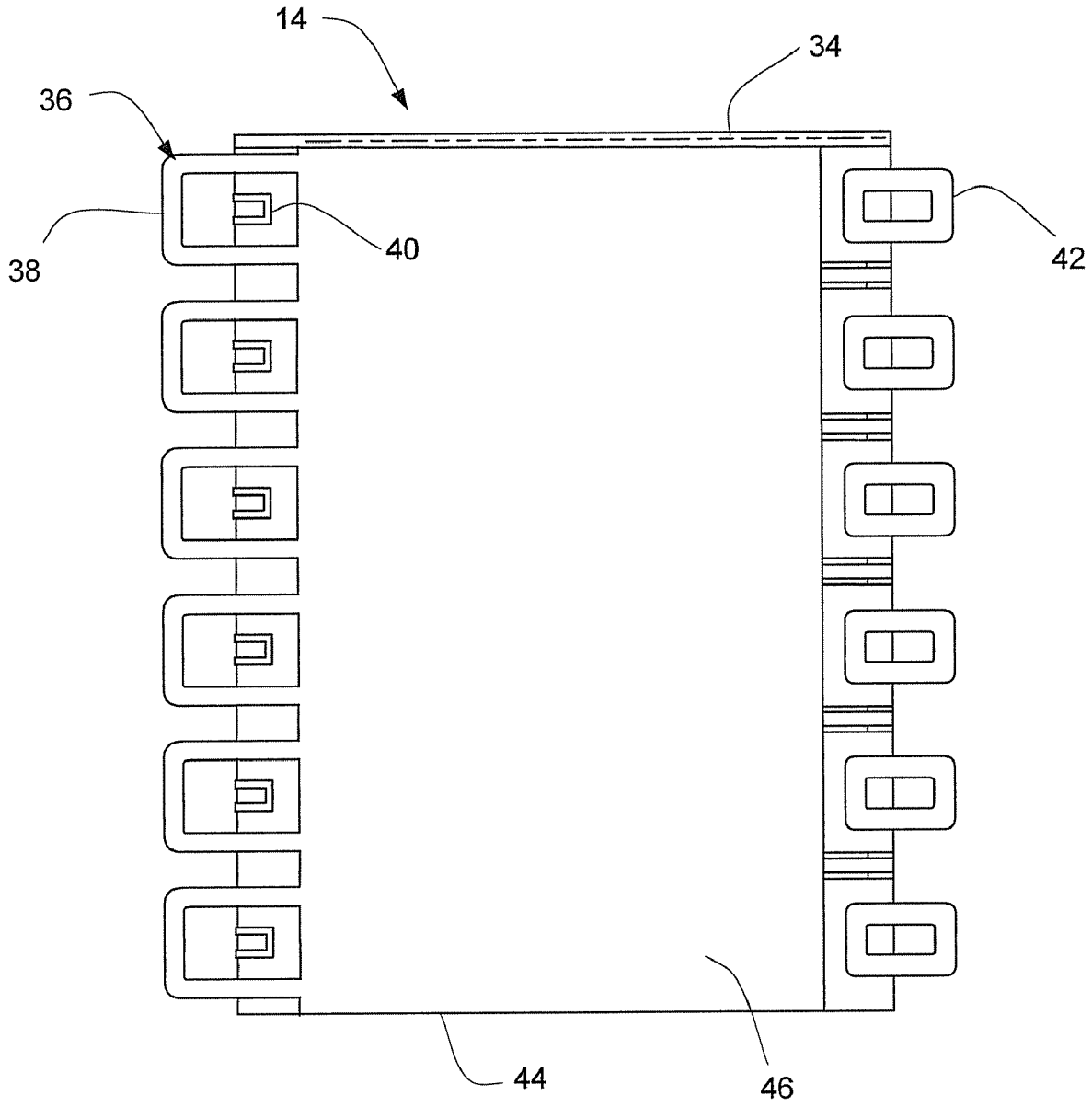
FIG. 2 is a diagram of an exemplary retaining wall panel, according to principles described herein.

Now referring to FIG. 2, a diagram of an exemplary panel (14) is illustrated. The panel (14) includes a panel body (46) with an upper edge (34) and a lower edge (44). A plurality of female tabs (36) is disposed along one edge of the panel body (46). The female tabs (36) are comprised of an outer loop (38)

and an inner protrusion (40). Corresponding male tabs (42) are disposed along the opposite edge of the panel body (46).

The panel body (46) is a structurally rigid member capable of withstanding forces exerted by walls of the pit (16). The body panel (46) may be constructed of a variety of materials including, but in no way limited to, metals or metal alloys, plastics, fiber reinforced plastics, composite materials, cementitious substrates, or other suitable materials. Additionally, the body panel (46) may be made in a variety of geometries, including a flat rectangular geometry or an arcuate geometry. Further, the body panel (46) may have a variety of thicknesses and stiffening geometries. By way of example and not limitation, the stiffening geometries may include corrugations, ridges or ribs, indentations, and the like. According to one exemplary embodiment, the upper edge (34) of the body panel (46) has been rounded to avoid injury to the users. Further, the upper edge (34) is preferably flush with surrounding surface (32, FIG. 1), reducing the chance of injury to a trampoline user who impacts the upper edge (34) of the retaining panel (14). According to one exemplary embodiment, the bottom edge (44) of the body panel (46) can rest on the bottom surface of the pit (16) or can extend beneath the bottom surface of the pit (16) for added stability or to compensate for variations in terrain.

According to the present exemplary embodiment, the female tabs (36) and the male tabs (42) form a series of interlocking connections that join adjacent panels (14) and creates a sectional retaining wall (12, FIG. 1). The male tab (42) is configured to be received by the outer loop (38) of the female tab (36). For additional locking stability, the male tab (42) encircles the inner protrusion (40) of the female tab (36).

Figure 3A:
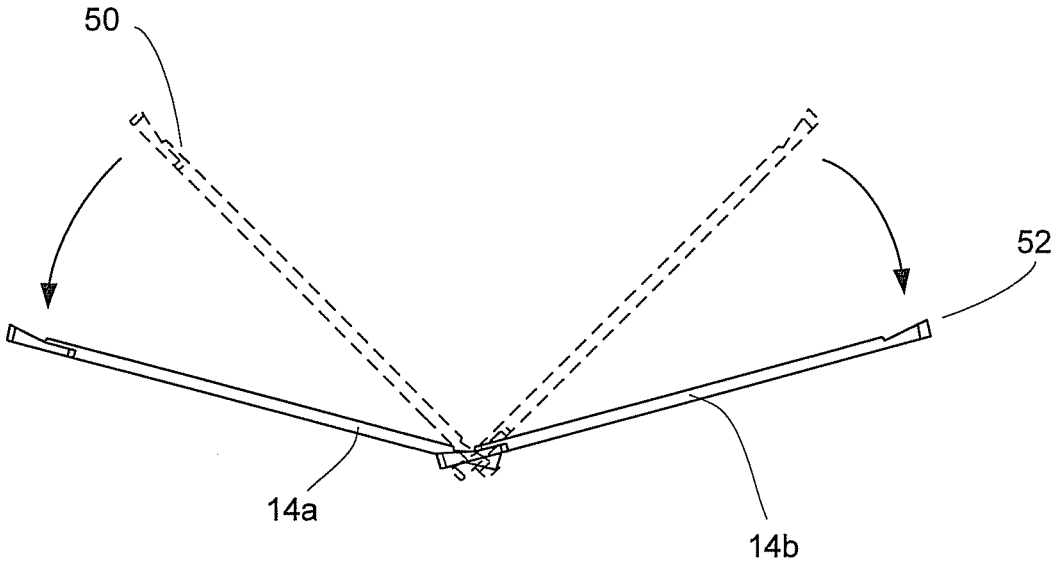
FIGS. 3*a* and 3*b* show a top view and a side view, respectively, of interlocking retaining wall panels, according to principles described herein.
Figure 3B:
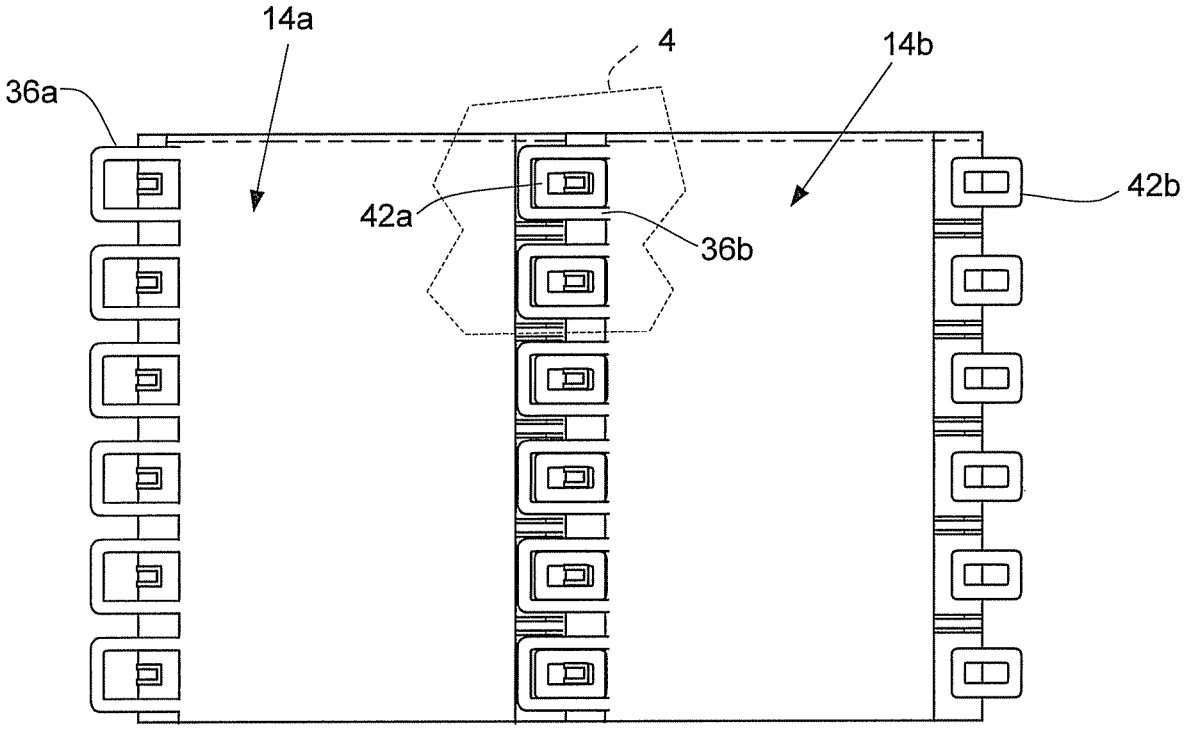

Now referring to FIG. 3*a* and FIG. 3*b*, a top and a side view, respectively, of exemplary interlocking panels are illustrated. In FIG. 3*b*, a first panel (14*a*) is shown adjacent to a second panel (14*b*). In this exemplary embodiment, the second panel (14*b*) is substantially identical to the first panel (14*a*). However, the interlocking panels need not be identical. Rather, an interlocking connection could be made between a variety of panels with different geometries and shapes. Returning again to FIG. 3*b*, the male tabs (42*a*) are disposed along the left-hand edge of the first panel (14*a*). During construction, the male tabs (42*a*) are inserted into the female tabs (36*b*), which according to one exemplary embodiment are disposed along the right hand edge of the second panel (14*b*). This insertion creates an interlocking connection that extends from the rounded upper edge (34) to the bottom edge (44) of each panel (14). In this exemplary embodiment, the geometry of the female tab (36*b*) and the male tab (42*a*) form the interlocking connection without the requirement for separate fastening hardware. A variety of other methods of creating interlocking connections between sectional panels could be used. By way of example and not limitation, several other geometries that are simple to assemble and require no additional hardware to make the interconnection include tongue and groove or hinge geometries. The dashed line (4) encircles a portion of the interlocking panels that is shown in a later diagram, FIG. 4. While the above-mentioned system and method is described as forming an interlocking connection that does not have the requirement for separate fastening hardware, a number of screws, bolts, and/or other fastening devices may be used, according to one exemplary embodiment, to couple the interlocking panels to the frame of the trampoline.

As shown in FIG. 3*a*, the interlocking connection is created by initially placing the first panel (14*a*) and the second panel (14*b*) in an assembly position (50). The male tabs (42*a*) attached to the first panel (14*a*) are then inserted into the openings formed by the interior surface of the outer loops (38*b*) of the second panel (14*b*). When the male tabs (42*a*) are fully inserted within these openings, the user then rotates the first panel (14*a*) and second panel (14*b*) to form the locked position (52). This positioning forces the various male tabs (42*a*) over the corresponding inner protrusions (40*b*), completing the interlocking connection. When the first panel (14*a*) and second panel (14*b*) are rotated to angles substantially more acute than the locked position (52), the interlocking connection may be disengaged. However, the interlocked panels (14) resist forces that tend to generate angles more obtuse than the locked position (52). These forces tend to reinforce the interlocking connection and further prevent the male tab (42*a*) from disengaging with the female tab (36*b*). This simple assembly/disassembly method for creating retaining wall (12, FIG. 1) lowers the time and expense of creating an in-ground trampoline system. Additionally, the retaining wall is easily removed, allowing the homeowner more freedom to make alterations to the landscape or relocate the in-ground trampoline.

Figure 4:
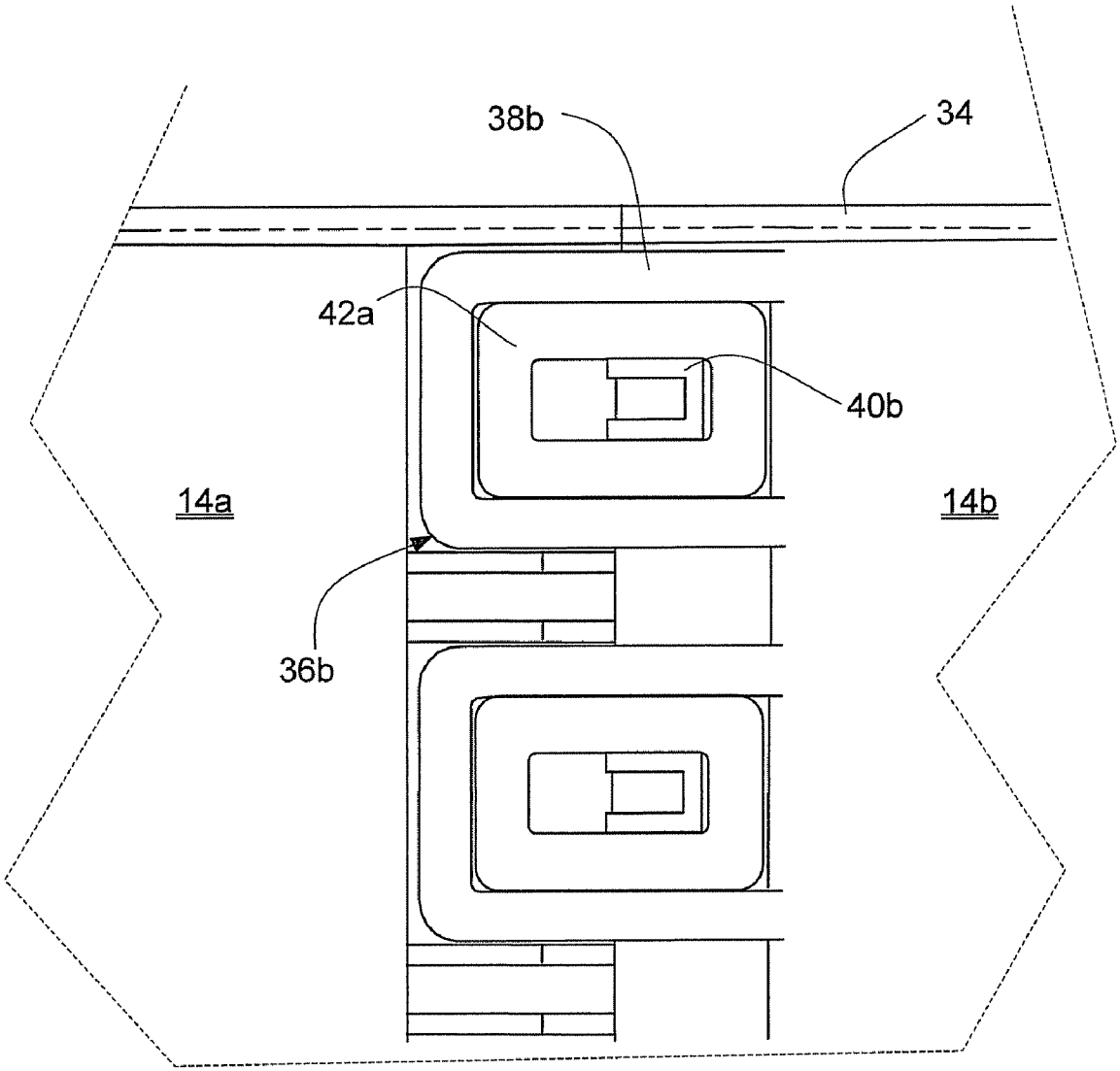
FIG. 4 is a detailed view of the interlocking portion of the sectional wall, according to principles described herein.

Now referring to FIG. 4, a detailed view of the interlocking connection between first panel (14*a*) and the second panel (14*b*) is illustrated. As shown, the male tabs (42*a*), according to one exemplary embodiment, are substantially rectangular. While the male tabs (42*a*) are illustrated as having a rectangular shape, any number of mating shapes may be shared between the male tabs (42) and the female tabs (36). According to the present exemplary embodiment, the outer loop (38*b*) is configured to receive the male tabs (42*a*) through the opening formed by the interior surface of the outer loop (38*b*). The female tabs (36*b*) and the male tab (42*a*) form an interlocking connection that joins adjacent panels (14) and creates a sectional retaining wall (12, FIG. 1). For additional locking stability, the male tab (42*a*) encircles the inner protrusion (40*b*) of the female tab (36*b*).

Figure 5:
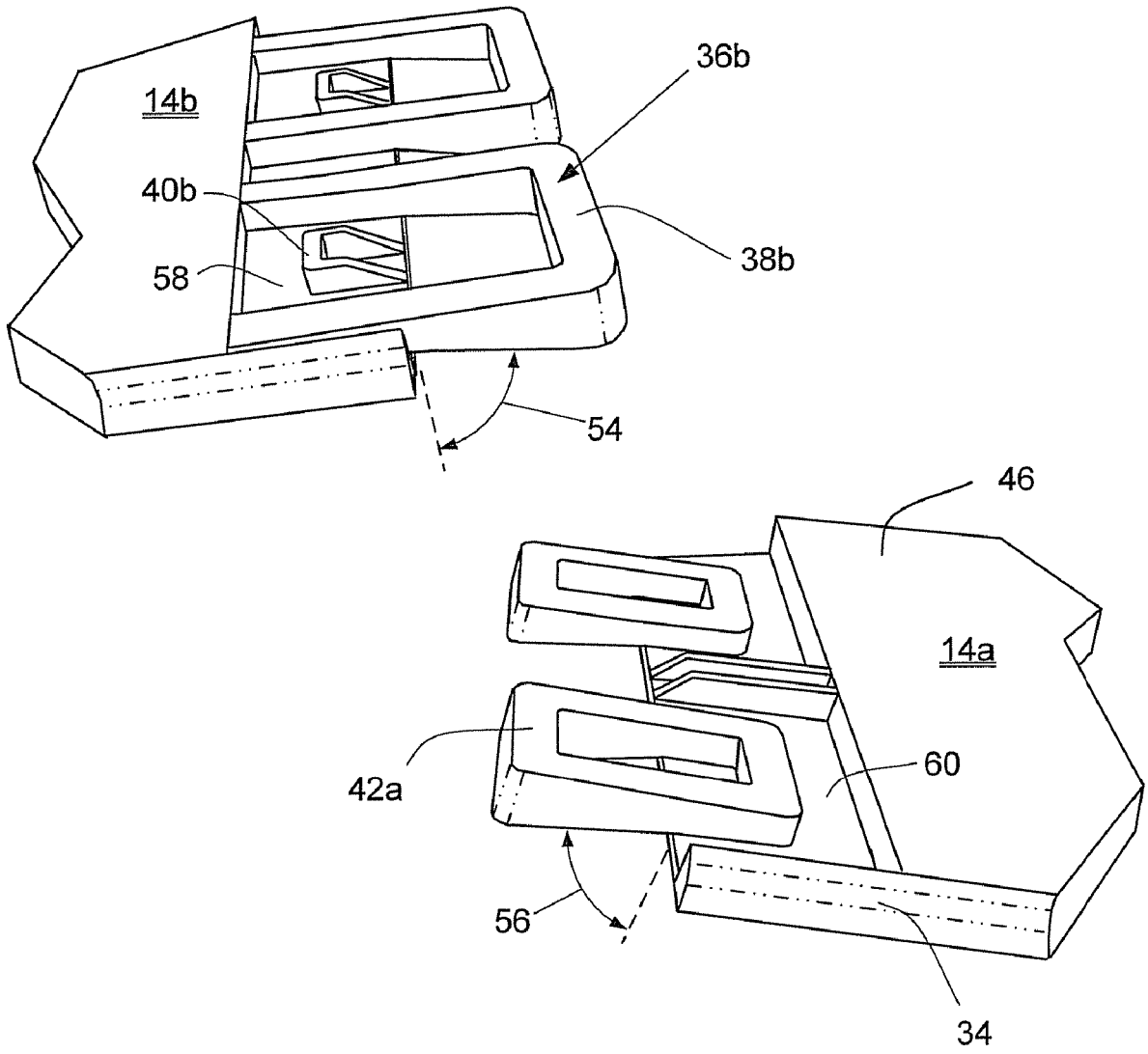
FIG. 5 is a perspective view of portions of the interlocking sectional wall, according to principles described herein.

Turning now to FIG. 5, a perspective view of mating portions of the first panel (14*a*) and the second panel (14*b*) are shown. The first angle (54) illustrated in FIG. 5 defines the geometry of the bottom surface of the outer loop (38*b*). The second angle (56) defines the geometry of the bottom surface of the male tab (42*a*). To form the exemplary interlocking connection, the male tab (42*a*) is inserted into the outer loop (38*b*). The panels (14*a*) and (14*b*) are then rotated until the bottom surface of the male tab (42*a*) contacts first surface (58) of the second panel (14*b*) and the bottom surface of the outer loop (38*b*) contacts the second surface (60) of the first panel (14*a*). The contact of bottom surface of the male tab (42*a*) with the first surface (58) of the second panel (14*b*) and the bottom surface of the outer loop (38*b*) with the second surface (60) of the first panel (14*a*) defines the locked position (52, FIG. 3). By way of example and not limitation, one method of changing the geometry of the retaining wall (12) is to alter the first angle (54) and the second angle (56), which changes the respective angles of the panels (14) in the locked position (52, FIG. 3).

Figure 6:
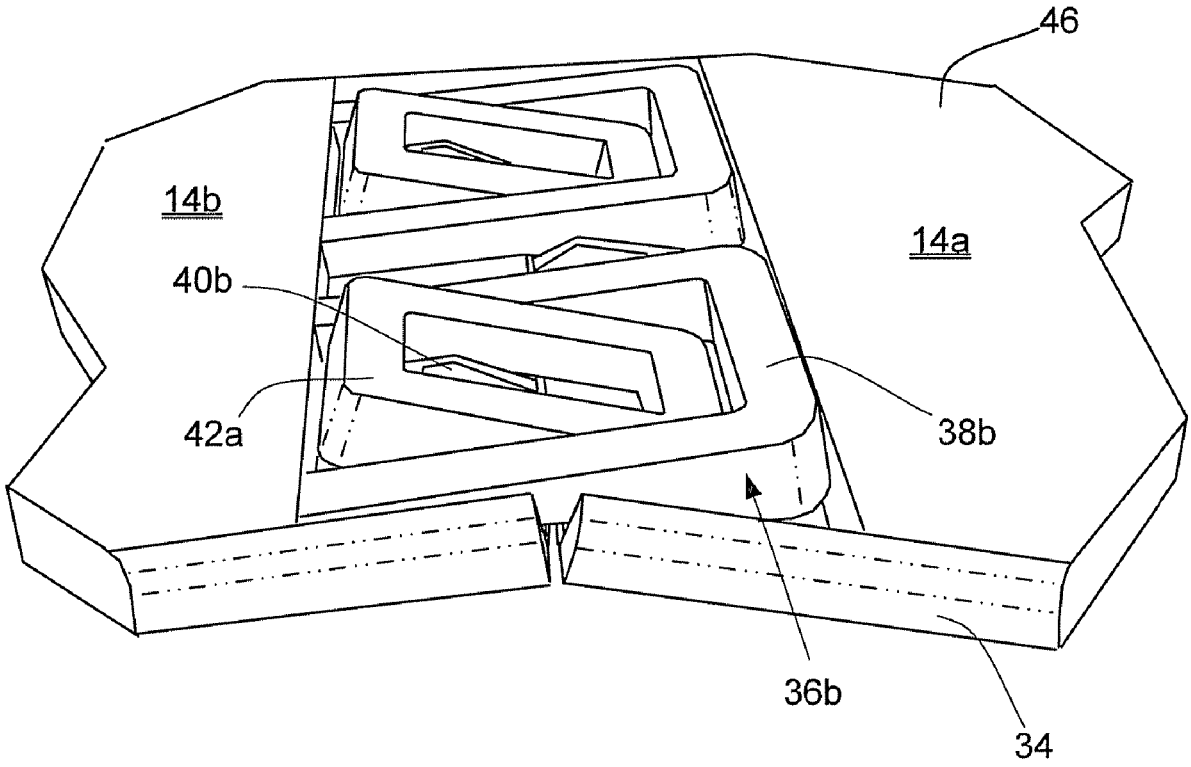
FIG. 6 is a perspective view of portions of the interlocking sectional wall, according to principles described herein.

Now referring to FIG. 6, a perspective view of the interlocking connection between the panels (14) is illustrated. As shown, the male tab (42*a*) has been inserted into the outer loop (38*b*) and the panels (14) have been rotated until the bottom surface of the male tab (42*a*) contacts the first surface (58, FIG. 5) of second panel (14*b*) and the bottom surface of the outer loop (38*b*) is in contact with the second surface (60, FIG. 5) of the first panel (14*a*). Due to the illustrated surface interactions, the panels (14) are in the locked position (52). The first panel (14*a*) and the second panel (14*b*) may be disconnected, according to one exemplary embodiment, by rotating one or both of the panels such that the male tab (42*a*) disengages the inner protrusion (40*b*).

Figure 7:
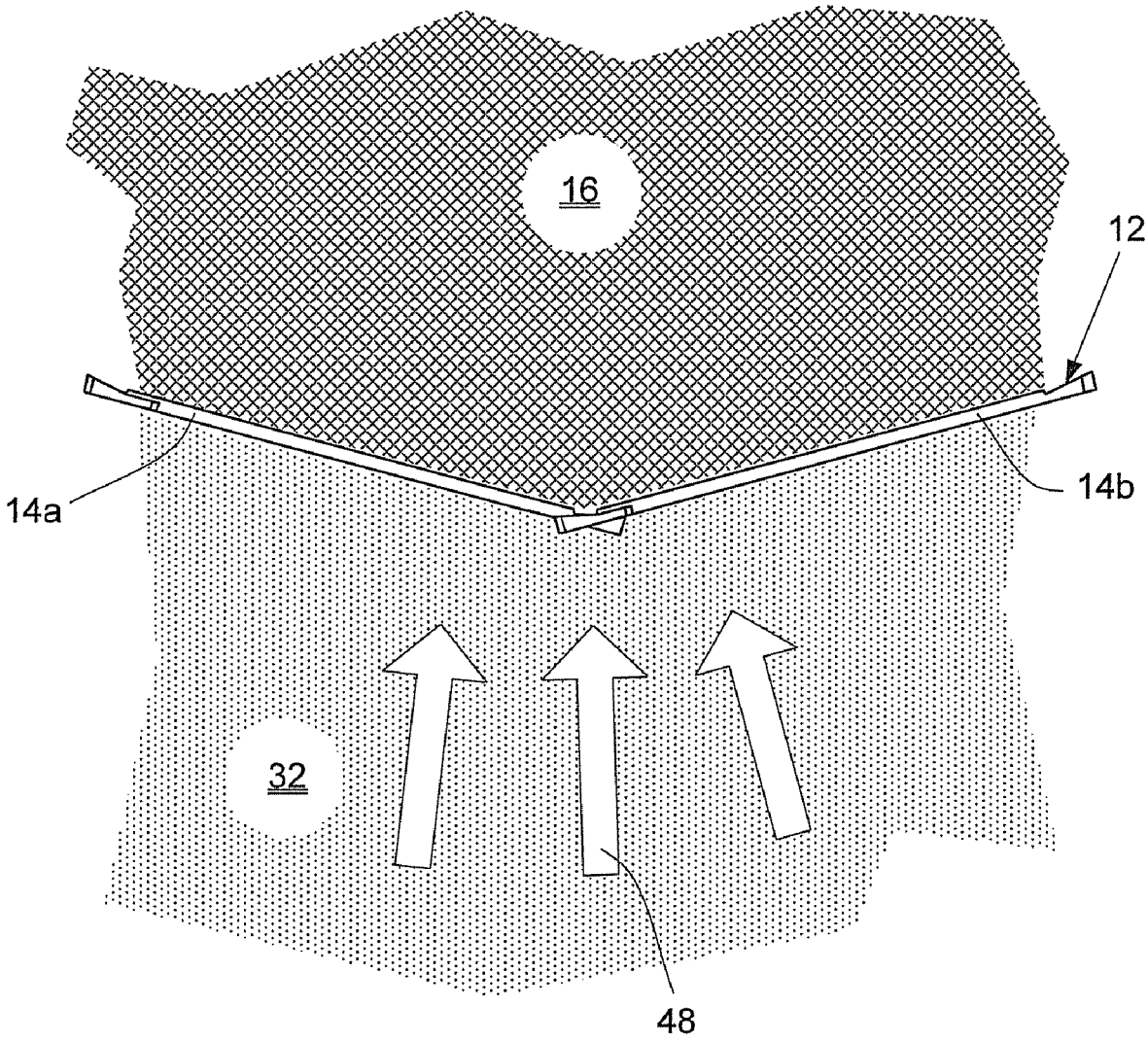
FIG. 7 is a diagram showing lateral ground forces acting the retaining wall panels, according to one exemplary embodiment.

Now referring to FIG. 7, a diagram of the exemplary lateral ground forces (48) exerted by the walls of the pit (16) on the sectional retaining wall (12) is illustrated. As shown, the lateral ground forces (48) are pressure or stress that the soil exerts against the outer surfaces of the retaining wall (12). The particular ground forces (48) that are shown in FIG. 7 act on the interlocking connection between the first panel (14*a*) and the second panel (14*b*). Similar ground forces act on other panels (14) that form the perimeter of the retaining wall (12). The lateral ground forces (48) create pressure on the panels that tends to strengthen the interlocking connection between the first panel (14*a*) and the second panel (14*b*). This pressure reinforces the locked position (52, FIG. 3) and tends to further force the male tab (42) over the interior protrusion (40), thus preventing the disengagement of the interlocking connection between first panel (14*a*) and the second panel (14*b*).

The interlocking connection between the panels (14) also allows the drainage of water through cracks between the joined panels. The reduction of the water level behind the joined panels (14) reduces the lateral ground forces (48) that act on the outer surface of retaining wall (12) in a similar fashion as weep holes in masonry retaining walls, thereby adding to the stability of the present system.

Figure 8A:
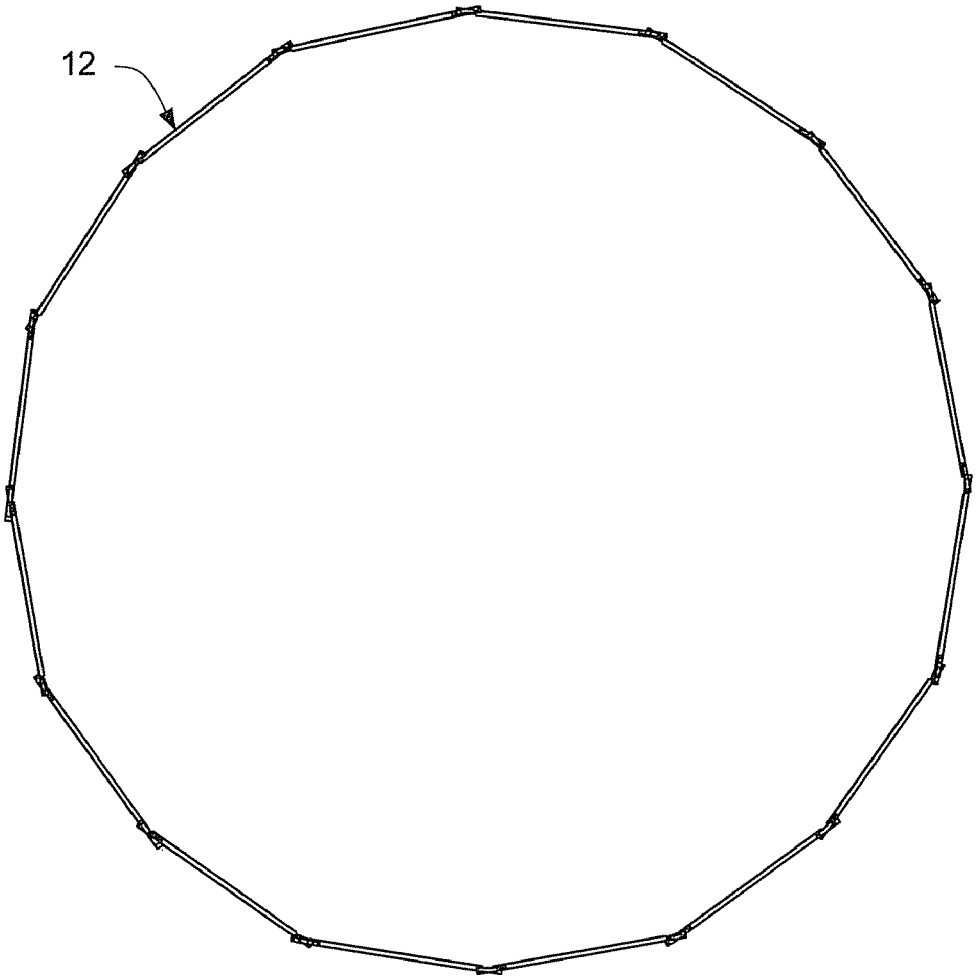
FIGS. 8*a* and 8*b* are diagrams of an exemplary retaining wall, according to the principles described herein.
Figure 8B:
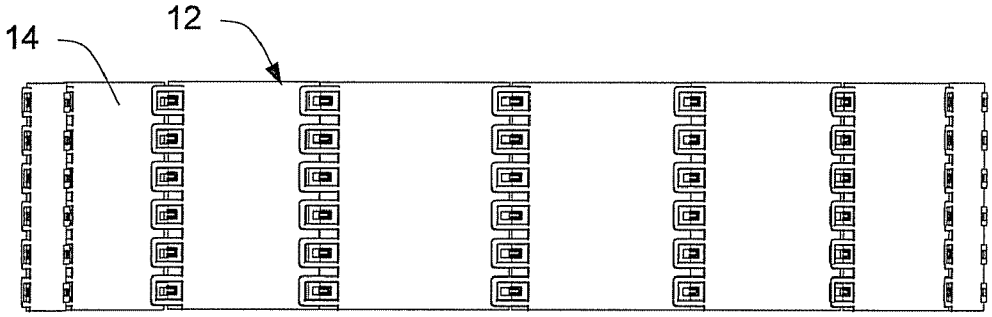

Now referring to FIG. 8*a* and FIG. 8*b*, an exemplary embodiment of the segmented retaining wall (12) is illustrated. FIG. 8*a* shows a diagram of a plurality of panels (14) interlocked to form a circular retaining wall (12). Although the retaining wall (12) has a circular geometry in FIG. 8, panels (14) could be assembled and used in any number of different geometries by varying the cross-sectional shape of the panels (14).

FIG. 8*b* shows a side view of the retaining wall (12) and the interlocking connections between panels (14), according to one exemplary embodiment. As described above, the advantages of this retaining wall system are its ease of manufacture, low cost of production, ease of assembly, and ability to receive a pre-assembled above ground trampoline for in-ground installation. Further, by altering the number of panels (14) that make up the retaining wall (12), the retaining wall (12) can be easily adapted to receive various sizes of above ground trampolines.

Figure 9A:
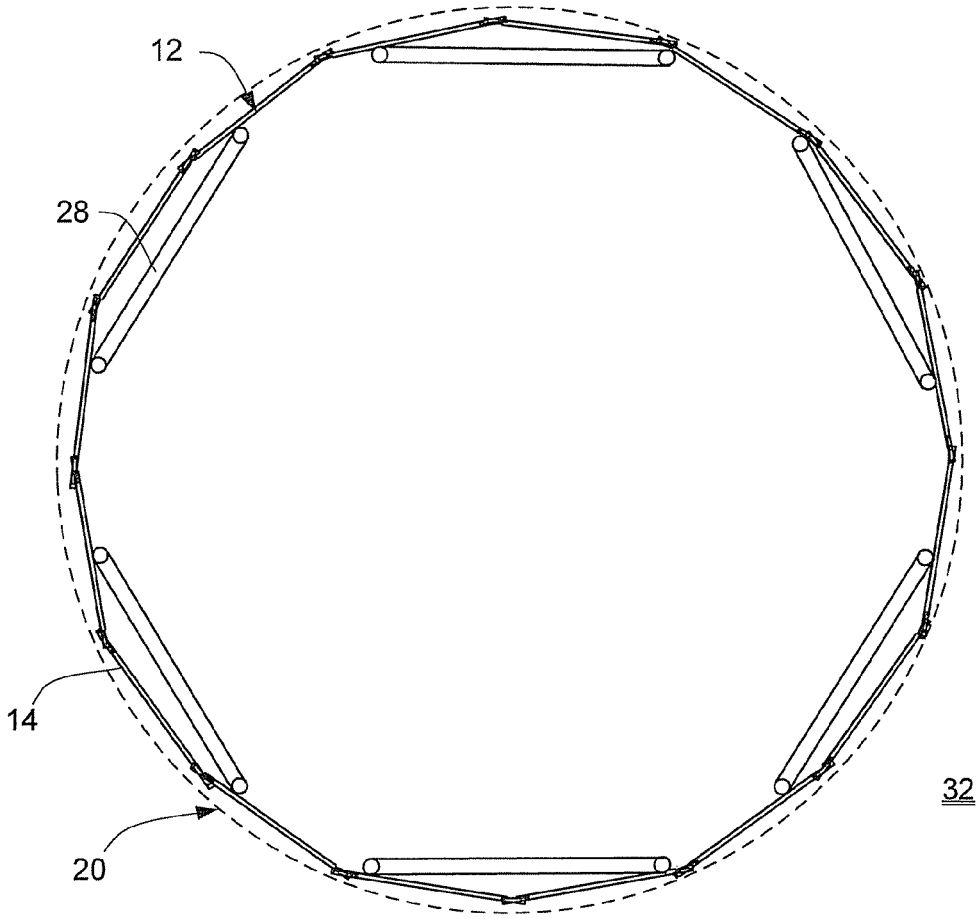

FIG. 9*a* shows a plan view of an in-ground trampoline system, according to one exemplary embodiment. The exemplary trampoline (20) is received within the depression formed by the pit (16) and the retaining wall (12). The upper surfaces of the trampoline (20), including the trampoline mat (22), the trampoline frame (24), and the protective pad (26) have been removed from this view to better show the interaction between the retaining wall (12) and the trampoline legs (28). The outline of the trampoline (20) a shown as a dotted line in FIG. 9*a*. In this exemplary embodiment, the trampoline legs (28) contact the interior perimeter of the retaining wall (12), providing additional support to the retaining wall (12) and preventing the undesirable motion of the trampoline legs (28).

Figure 9B:
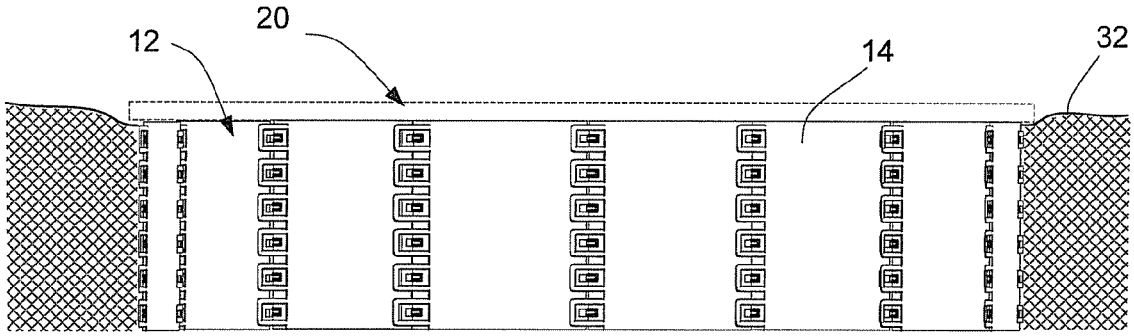

FIG. 9*b* shows the dotted outline of the protective pad (26) extending over the upper surface of the retaining wall (12). In this configuration the retaining wall (12) poses a significantly reduced risk to the trampoline user because it is substantially under the protective pad (26) that is attached to the trampoline frame (30). FIG. 9*b* also shows the surrounding surface (32), which is at substantially the same height as the trampoline mat (22), reducing the likelihood of injury to trampoline users who fall from the trampoline (20). The surrounding surface (32) may be comprised of wood chips, closed cell foam, rubber or the like to further reduce the likelihood of injury to the trampoline users.

FIG. 9*b* further illustrates a potential use for the sectional retaining wall (12), according to one exemplary embodiment. In an alternative embodiment, the in-ground trampoline apparatus and retaining wall are used above ground, wherein the retaining wall (12) advantageously precludes children and/or pets from crawling beneath trampoline mat (22) and becoming injured or killed from impact imparted via jumpers above.

The preceding description has been presented only to illustrate and describe embodiments and examples of the principles described. This description is not intended to be exhaustive or to limit these principles to any precise form disclosed. Many modifications and variations are possible in light of the above teaching.

What is claimed is:

1. An in-ground trampoline system, comprising:

a trampoline;

a pit defined by a wall; and a segmented retaining wall configured to support said wall of said pit;

wherein said segmented retaining wall comprises at least a first interlocking panel and a second interlocking panel, each of said first interlocking panel and said second interlocking panel including a first surface and a second surface, said first surface having a receiving component, and said second surface having an engagement component, said engagement component being configured to be received by and engage said receiving component;

wherein said receiving component further includes at least one outer loop extending beyond said first surface and an inner protrusion disposed at an edge of said first surface;

wherein said engagement component includes a tab, said tab being configured to be received within said outer loop and engage said inner protrusion; and wherein said segmented retaining wall is configured to be interconnected by placing said first interlocking panel a first angle relative to said second interlocking panel and inserting said engagement component into said outer loop portion of said receiving component; and then placing said first interlocking panel at a second angle relative to said second interlocking panel causing said receiving component to engage said inner protrusion to interlock said first and second interlocking panels.

2. The in-ground trampoline system of claim 1 wherein said first interlocking panel and said second interlocking panel are configured to be joined together independent of additional hardware.

3. The in-ground trampoline system of claim 1 wherein said segmented retaining wall is self supporting.

4. The in-ground trampoline system of claim 1 wherein said segmented retaining wall is additionally supported by said trampoline.

5. The in-ground trampoline system of claim 4, wherein said trampoline further comprises a frame including a plurality of legs;

wherein said frame including a plurality of legs further support said segmented retaining wall.

6. The in-ground trampoline system of claim 2 wherein said first interlocking panel and said second interlocking panel are rectangular.

7. The in-ground trampoline system of claim 6, wherein said first interlocking panel is identical to said second interlocking panel.

8. The in-ground trampoline system of claim 1 wherein said in-ground trampoline system is configured for use above-ground.

9. The in-ground trampoline system of claim 1, wherein:

said outer loop portion of said receiving component has a generally rectangular shape; and said engagement component has a generally rectangular loop shape, wherein said loop defines an orifice configured to receive said inner protrusion.

10. The in-ground trampoline system of claim 9, wherein each of said first interlocking panel and said second interlocking panel include a plurality of receiving components on said first surface and a plurality of engagement components on said second surface.

* * * * *